United States Patent [19]

Pöhl

[11] Patent Number: 4,632,170

[45] Date of Patent: Dec. 30, 1986

[54] METHOD AND APPARATUS FOR MAKING PRECISION METAL CASTINGS

[76] Inventor: Andreas Pöhl, Haydnstrasse 5, 8077 Reichertshofen, Fed. Rep. of Germany

[21] Appl. No.: 780,331

[22] Filed: Sep. 26, 1985

[30] Foreign Application Priority Data

Dec. 18, 1984 [DE] Fed. Rep. of Germany ..... 3446139

[51] Int. Cl.[4] ..... B05B 7/22

[52] U.S. Cl. ..... 164/250.1; 164/46; 164/337; 118/302

[58] Field of Search ..... 164/46, 492, 250.1, 164/335, 337; 118/302; 427/422

[56] References Cited

U.S. PATENT DOCUMENTS 1,688,645 10/1928 Novotny ..... 164/46 X 2,101,922 12/1937 Stoesling ..... 118/302 X

FOREIGN PATENT DOCUMENTS 1379261 1/1975 United Kingdom ..... 164/46

*Primary Examiner*—Kuang Y. Lin

*Attorney, Agent, or Firm*—Wegner & Bretschneider

[57] ABSTRACT

Metal to be cast is melted in melting chamber of casting furnace. Molten metal flows through a nozzle of the melting chamber is atomized by a stream of heated compressed air. Droplets of molten metal are carried by the air stream to a mold onto which the metal is cast to form a thin even molding. The hot air stream prevents the molten metal droplets from solidifying until they reach the mold. The amount of metal cast and the thickness of the molding may be controlled by adjusting the velocity of the air stream and the distance from the nozzle to the mold.

6 Claims, 3 Drawing Figures

METHOD AND APPARATUS FOR MAKING PRECISION METAL CASTINGS

BACKGROUND OF THE INVENTION

1. Field of the Invention

The invention relates to a novel method and apparatus for casting molten metal to form high quality thin-walled metal moldings.

2. Description of the Prior Art

The method of casting metal moldings between male and female ceramic molds is well-known in the field of casting, but has the disadvantage that the thickness of the molding cannot be varied. Also well-known is a method of casting whereby molten metal is poured over a single mold, but this method leads to the destruction of wooden molds and the moldings produced are not of even thickness.

Higher technology has led to the galvanization methods (including hot dipping, sherardizing, and electroplating) and erosion systems, but these processes require extensive mechanization, at a high cost, and the rate of production is slow.

A method of producing thin-walled metal moldings has been developed whereby the metal is vaporized and blown onto a mold, but the machinery and raw materials for this process are expensive, production is slow, the molds are damaged by the process, and the metal undergoes structural changes.

SUMMARY OF THE INVENTION

It is therefore the object of the present invention to provide a casting system that has the advantages found with the higher technology processes of precision casting of thin-walled metal moldings but at lower cost, with shorter production times, without destruction of the mold used to produce the molding, and without incurring structural changes in the metal that is cast.

The above objects and others are achieved by a method of casting whereby the metal to be cast is melted and the molten metal is atomized into droplets and carried to the mold onto which it is to be cast by a stream of air that has been heated to the melting point of the metal. The invention includes a casting furnace with a special nozzle for employing the above method of casting.

According to the invention solid metal is melted in a melting chamber of the casting furnace. The moltem metal leaves the melting chamber through a nozzle attached to an opening in the melting chamber. A jet-stream of heated air meets the molten metal at the open end of the nozzle and atomizes the liquid. The air stream also carries the molten metal droplets to the mold onto which the metal is to be cast. The heated airstream provides a protective shield for the molten metal droplets as they travel toward the mold and prevents the molten metal droplets from solidifying before they reach the mold. The molten metal droplets fuse into a thin even layer on the mold.

DETAILED DESCRIPTION OF THE INVENTION

The invention is best described with reference to the above mentioned drawings, which illustrate the preferred embodiment of the method and apparatus but are not intended to limit the scope of the invention.

Figure 1:
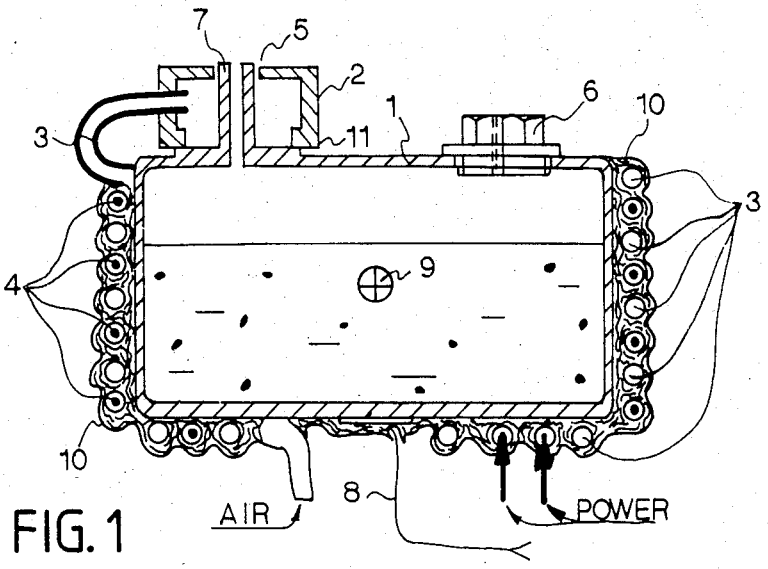
FIG. 1 shows a cross-section of a casting furnace according to the invention.
Figure 2:
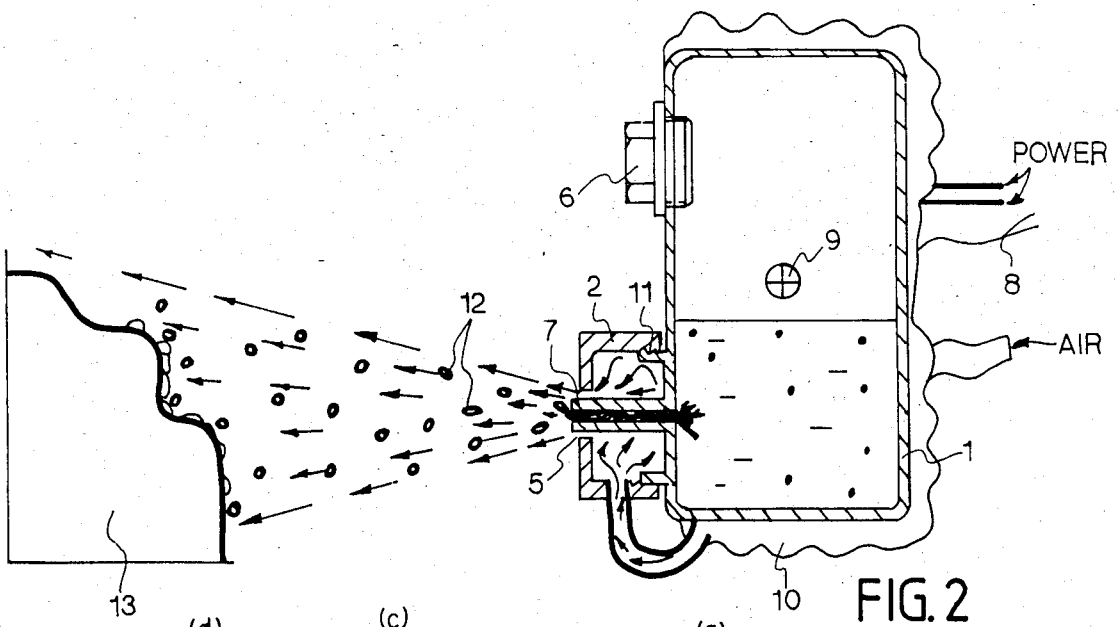
FIG. 2 shows the same furnace in operation in the casting position.

FIG. 1 shows the melting chamber (1), which should be made of a thermally conducting material such as metal. The solid metal to be cast is supplied to the melting chamber through opening (6). The opening may be equipped with a valve for ventilating excess air pressure. The furnace may be brought into a position for casting (shown in FIG. 2) by rotation about pin form bearing (9). Attached to an opening in the melting chamber is nozzle (7). Gravitational force causes the metal to flow through the nozzle when the furnace is tipped into the casting position. The inner diameter of the nozzle is typically 0.5 to 2.5 mm.

The melting chamber is heated by means of heating element (4) which is wound around the melting chamber. In the preferred embodiment of the invention, the heating element is a resistance heating tube. These heating tubes are composed of an outer metal tube that is a good thermal conductor, an aluminum oxide powder insulating layer, and a resistance wire coil in the center of the tube, and are presently known, for example for use in electric stoves. Resistance heating tubes are the preferred heating element because they may be easily bent to conform to the exterior shape of the melting chamber, and because they are light weight, easy to maintain and readily available. However, other melting systems would be useful as well. The heating element is regulated by thermostat (8), which can be set to the melting point temperature of the metal to be cast.

According to the preferred embodiment of the invention, air tube (3) is wound around the melting chamber integrally with the heating element. Accordingly the heating element serves not only to melt the metal in the melting chamber but also to heat the compressed air which is used in the invention. The air tube should be made of a good thermally conducting material such as metal.

Figure 3:
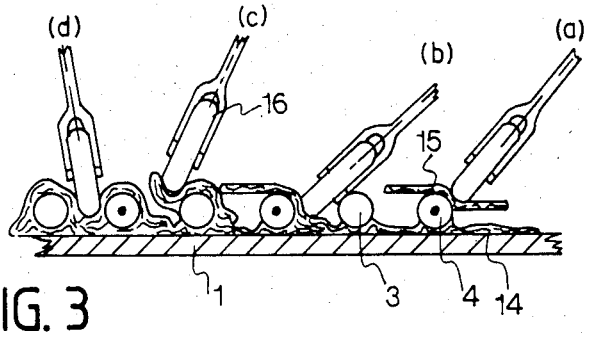
FIG. 3 shows a method of preparing the heating element and air tube according to the preferred embodiment of the invention.

The melting chamber, heating element and air tube all may be thermally connected, as shown by element (10) in FIG. 1. A preferred method of thermal connection is illustrated in greater detail in FIG. (3). Layers of heat conducting foil such as aluminum or copper are wrapped around the three elements such that the space between them is filled completely with foil. FIG. 3 shows melting chamber (1), air tube (3), heating element (4), a base layer of foil (14) and an outer layer of foil (15). Steps (a), (b), (c) and (d) for constructing the thermal connection using tool (16) are shown.

The air tube should be connected to a supply of compressed air such that the air pressure is adjustable. The inner dimensions (i.e. length and diameter) of the air tube are selected so that the volume of air contained by the air tube is heated to the melting point temperature of the metal to be cast during the time required for the passage of that volume of air through the tube at a given velocity. The compressed air should not be heated above the melting point of the metal because corrosion of the metal and melting through of the molding can result.

The air tube that carries the compressed air is connected to sleeve (2) surrounding the nozzle according to the preferred embodiment of the invention. The heated compressed air circulates inside the sleeve and maintains the molten metal inside the nozzle in a liquid state. The sleeve and the nozzle form a narrow annular opening (5) through which the heated compressed air is accelerated to form a jet stream as it exits the sleeve. The difference between the outer radius of the nozzle and the inner radius of the sleeve is generally about 5 mm.

The jetstream of air creates a vacuum that controls the amount of molten metal that flows from the nozzle and is carried to mold (13) onto which the metal is cast. the amount of metal cast may also be controlled by the length of time that the furnace is in the casting position. The molten metal is atomized by the jetstream of air into droplets (12) generally ranging in size from 0.1 to 2.0 mm. The size of the droplets decreases with increasing velocity of the air stream, which may be controlled by adjusting the air pressure. The thickness of the molding produced may be controlled by adjusting the velocity with which the molten metal droplets reach the mold by adjusting the velocity of the air stream and/or the distance between the nozzle and the mold. The mold is generally set 10 to 20 cm from the end of the nozzle.

The air stream is shaped like a solid cone that forms a protective shield around the molten metal droplets and prevents the droplets from solidifying before they reach the mold. The diameter of the solid cone is controlled by adjusting the position of the sleeve along the longitudinal axis of the nozzle by turning the sleeve about threaded joint (11).

The air pressure in the sleeve is generally about 4 $kg/cm^2$ when a fine-surfaced mold is used and about 2 $kg/cm^2$ when a rough-surfaced mold is used. The desired air velocity depends on the specific weight of the metal to be cast and should be maintained such that the molten metal droplets solidify on the mold to form a uniform thin-walled casting. The velocity can be decreased during the casting process so that fine droplets are applied to the mold initially, while larger droplets are deposited after the initial layer is formed.

The entire furnace may be insulated with a multilayer metal and/or ceramic cover. The furnace may be held by a balancer that is common in the metal casting industry.

The preferred embodiment of the method of casting according to the invention comprises the following steps.

The melting chamber is filled with solid metal; the thermostat for the heating element is set to the melting point temperature of the metal; and the metal is melted.

The mold onto which the metal is to be cast is placed vertically in front of the furnace. When the metal has melted, the air stream is turned on and the furnace is tipped into the casting position. The mold is coated with a thin layer of molten metal which solidifies to form the moling product. The furnace is tipped out of the casting position to end the casting step.

The solidified molding may be blown off from the mold. Molds may be treated with a special parting agent or contact skin made of cellulose dissolved in alcohol that eases the separation of the molding from the mold. by using the method of casting according to this invention, it has been discovered that molds, even wooden molds, are not burned by the molten metal. The first layer of molten metal solidifies quickly and serves to distribute the heat of added layers, thus protecting the mold from the subsequent layers.

Examples of metal alloys that can be used in the invention and the corresponding range of melting point temperatures are shown below.

Bismuth and Antimony alloys (Bi+Sb): 120°–150° C.

Lead and Tin alloys (Pb+Sn): 150°–250° C.

Aluminum, Copper and Nickel alloys (Al+Cu+Ni): 350°–450° C.

The method of casting according to this invention is useful for producing tools, masks, reliefs, coatings, linings and armor.

I claim:

1. A furnace for melting metal and casting the molten metal to form metal moldings, comprising:

(a) a melting chamber for melting the metal to be cast;

(b) means for heating the melting chamber comprising a heating element wound around the melting chamber;

(c) thermostat means for controlling operation of the heating element;

(d) a nozzle in fluid communication with an opening in said melting chamber, through which molten metal flows;

(e) air tube means wound around the melting chamber with the heating element;

(f) a source of compressed air in fluid communication with said air tube means;

(g) means for heating air in said air tube means, comprising said heating element;

(h) a sleeve surrounding said nozzle, in fluid communication with said air tube means; and (i) an opening in said sleeve through which heated air from said air tube means is accelerated as it exits said sleeve, said opening being oriented so that air exiting and sleeve atomizes and carries molten metal from said nozzle.

2. A furnace according to claim 1, further comprising mounting means enabling the furnace to move into a position for casting in which molten metal flows through said nozzle.

3. A furnace according to claim 1, wherein the position of said sleeve is adjustable along the longitudinal axis of said nozzle.

4. A furnace according to claim 1, wherein said heating element comprises a resistance heating tube.

5. A furnace according to claim 1 wherein the length and diameter of said air tube are such that during passage through said air tube the air is heated to about the melting point of the metal.

6. A furnace according to claim 1, wherein said melting chamber, said heating element, and said air tube are thermally connected.

* * * * *